US005357832A

United States Patent [19]

Ferguson

[11] Patent Number: 5,357,832

[45] Date of Patent: Oct. 25, 1994

[54] WEB FEED APPARATUS WITH MARGIN CUTTER

[75] Inventor: Gregory A. Ferguson, New Bedford, Mass.

[73] Assignee: Precision Handling Devices Inc., Fall River, Mass.

[21] Appl. No.: 148,549

[22] Filed: Nov. 8, 1993

Related U.S. Application Data

[63] Continuation of Ser. No. 994,731, Dec. 22, 1992, abandoned.

[51] Int. Cl.[5] ..... B26D 1/24

[52] U.S. Cl. ..... 83/423; 83/433; 83/504; 400/62.11

[58] Field of Search ..... 83/423, 433, 504, 508.1, 83/501, 503; 400/621.1

[56] References Cited

U.S. PATENT DOCUMENTS

| | | | |
|---|---|---|---|
| 2,399,154 | 4/1946 | Antrim et al. | 83/423 |
| 3,039,345 | 6/1962 | Euth | 83/423 |
| 3,056,324 | 10/1962 | Lach | 83/423 X |
| 3,774,489 | 11/1973 | Kercher et al. | 83/423 |
| 3,905,262 | 9/1975 | Stromberg | 83/423 X |
| 4,222,809 | 9/1980 | McLean et al. | 83/423 X |
| 4,423,975 | 1/1984 | Krenz | 400/616 |
| 4,583,459 | 4/1986 | Abendroth et al. | 101/217 |
| 4,616,773 | 10/1986 | Keriuan | 225/99 |
| 4,765,523 | 8/1988 | Ferguson | 226/74 |
| 4,940,347 | 7/1990 | Lund | 400/621.1 |
| 4,993,856 | 8/1990 | Chung | 400/621.1 |
| 4,995,520 | 9/1990 | Ferguson | 226/74 |
| 5,092,697 | 3/1992 | McKenna | 400/621.1 |
| 5,102,246 | 4/1992 | Patz | 400/621.1 |
| 5,120,144 | 6/1992 | Lund | 400/621.1 |

FOREIGN PATENT DOCUMENTS 0297163 12/1986 Japan ..... 400/621.1

*Primary Examiner*—Richard K. Seidel
*Assistant Examiner*—Kenneth E. Peterson
*Attorney, Agent, or Firm*—M. Lukacher

[57] ABSTRACT

A web feed device, particularly a tractor for feeding perforated paper, is provided with the capability of automatically cutting a margin along the edge of the paper. Where this margin is defined by side perforations, the apparatus is operative to burst the perforations automatically. The tractor has a lid which is spring biased in a closed position spaced from a surface of the frame of the tractor over which the paper is driven, as by a belt having pins which are received in feed perforations along the margin between the side perforations and the edge where the belt is entrained around a sprocket which drives the belt. The mechanism has a lower cutting disk, driven with the sprocket and presenting a cutting edge along an outside surface. An upper disk is reciprocally movable in a housing against the bias of a spring, which maintains the upper disk in retracted (non-cutting) position, to cutting position where a cutting edge between an inside surface of the upper disk overlaps the outside surface of the lower disk to form a cutting scissor for cutting the margin or bursting the side perforations. The cutting action is selectively enabled by manually advancing the upper disk, thereby selectively providing a cutting mode of operation and enabling the upper disk to release from the lower disk, when in its cutting mode position, automatically—as when a paper jams occurs and the lid is forced away its closed position when the housing is mounted on the lid.

29 Claims, 7 Drawing Sheets

WEB FEED APPARATUS WITH MARGIN CUTTER

This is a continuation of application Ser. No. 07/994,731, filed Dec. 22, 1992, now abandoned.

DESCRIPTION

The present invention relates to web feeding apparatus for cutting marginal strips from webs and particularly to a mechanism which enables cutting the web in the direction in which the web is being fed, and especially along an edge, so as to trim a margin from the web, and if the margin is defined by side perforations, to burst such perforations. The invention provides web feeding apparatus in which such a mechanism is integrated.

The invention is especially suitable for use in providing an edge trimming or side perforation bursting mechanism for use in a web feed device, such as a paper feed tractor, having a lid which is movable between an open position and a closed position where it is spring biased and guides the web along a surface of the frame along which the web moves as it is driven by a web drive mechanism mounted in the frame. Such a tractor is shown, for example, in U.S. Pat. No. 4,955,520 issued on Sep. 11, 1990 to Gregory A. Ferguson and assigned to Precision Handling Devices, Inc. of Fall River, Mass. The edge trimmer/side perforation bursting mechanism is integrated in the tractor and it is manually operable to select a cutting mode by moving a cutter of the mechanism between a non-cutting mode position and the cutting mode position. The cutting mechanism may be in non-interfering relationship with the web in the non-cutting mode and may be automatically reset to the non-cutting mode when the lid opens, either when actuated to open position manually or in response to a jam or pileup of the web which increases the tension on the web and tends to open the lid.

Various mechanisms have been proposed for cutting or bursting perforations to avoid the need to manually remove the so-called "tear strips" along the side edges of perforated paper or computer forms. Some use cutting blades or disks. See the following U.S. Pat. Nos.: Abendroth et al., 4,583,459, Apr. 22, 1986; Chung, 4,993,856, Feb. 19, 1991; and Patz, 5,102,246, Apr. 7, 1992. Others use members which deflect the paper along the margin at the side perforations to burst the perforations. See Krenz, 4,423,975, Jan. 3, 1984; Kerivan, 4,616,773, Oct. 14, 1986; Lund, 4,940,347, Jul. 10, 1990; McKenna, 5,092,697, Mar. 3, 1992; and Lund, 5,120,144, Jun. 9, 1992. All of such mechanisms, when installed are disposed to provide their cutting action and are not capable of being selectively positioned in either a cutting mode or a non cutting mode. When in their cutting mode the deflecting or cutting members are in interfering relationship with the paper. In the event of a paper jam, it is likely that they will exacerbate the jam. When positive cutting action is required as by moving the cutter, instead of merely allowing the paper to be driven past the cutter, separate drive trains are used which makes it difficult or impractical to integrate the cutting mechanism with the paper feed or tractor device.

It is an object of the present invention to provide an improved mechanism for cutting or trimming a marginal strip along an edge of the web.

It is a more specific object of the invention to provide an improved mechanism for web cutting or web perforation bursting which is capable of selectively providing cutting and non-cutting modes of operation.

It is a still further object of the present invention to provide an improved cutting mechanism for use in a web feed device sometimes called a document feed tractor which mechanism automatically shifts to a position where it is in a no-cut mode, and is out of interfering relationship with the web as it is being fed, upon occurrence of other events in the operation of the web feed, such as a jam or when the feed device is intentionally opened to gain access to the web.

It is a still further object of the invention to provide an improved mechanism for cutting or trimming marginal strips from a web, such as perforated computer paper or forms (whether fan-folded or continuous) which may be assembled as an integral part of a web feed device such as a tractor, either using a belt having pins which are received in feed perforations in the paper or project radially from a drive wheel (i.e., a pinwheel).

Briefly described, the invention according to a presently preferred embodiment may be incorporated in a web feed device having a drive mechanism engagable with the web which drives the web in a longitudinal direction along the side edges thereof. The drive mechanism is rotatably supported in a frame, along a surface of which the web is driven. A lid associated with the frame is mounted for movement with respect to the frame between a position adjacent to the frame's surface where the lid is in guiding relationship with the web and a position away from that surface. A mechanism for cutting a marginal strip along one of the side edges of the web may be integrally assembled with the web feed device. The mechanism includes a first cutter rotatable with the drive mechanism and having a cutting edge. A second cutter is supported on the lid for reciprocal lateral movement with respect to the web and has its own cutting edge. Means are providing for selectively moving the second cutter with respect to the first cutter between positions where their cutting edges are in cutting relationship and provide a cutting mode of operation and where the cutting edges are out of cutting relationship with each other (the non cutting mode). Preferably, the second cutter is spring biased in its non cutting mode position and is disposed a non interfering relationship with the web as it is driven. The cutting edges of the cutting elements are disposed in overlapping relationship when in the cutting mode to define a scissor. The first cutter element may be a disk which is connected in driving relationship with the web drive mechanism and the second cutter may be a disk which is free to rotate but rotates, when in the cutting mode via drive forces transferred thereto, either from the first cutter disk or from the web or both thereby providing positive cutting action so as to enable the cutting of webs which do not have side perforations to demark marginal strips or tear strips. The improved marginal strip cutting mechanism is also useful separately from the web feed device.

The foregoing and other objects, features and advantages of the invention will become more apparent from a reading of the following description in connection with the accompanying drawings in which.

Figure 1:
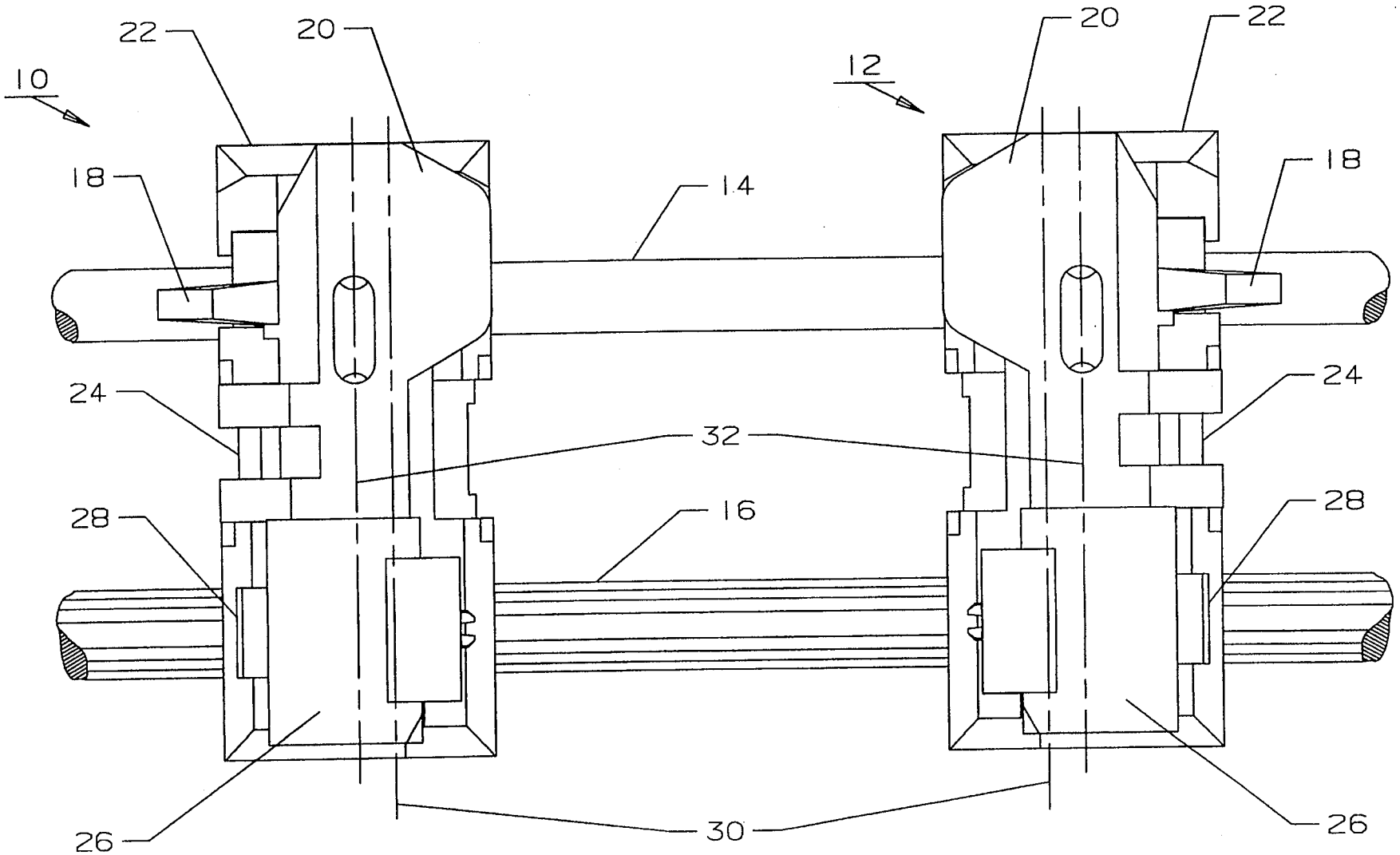
FIG. 1 is a plan view which shows web feeding apparatus in accordance with the invention embodied in a pair of tractors mounted on drive and support shafts with their lids in closed position and having mechanisms for cutting or bursting marginal strips along the side edges of the webs (the web being single or multiple layers of paper)
Figure 2:
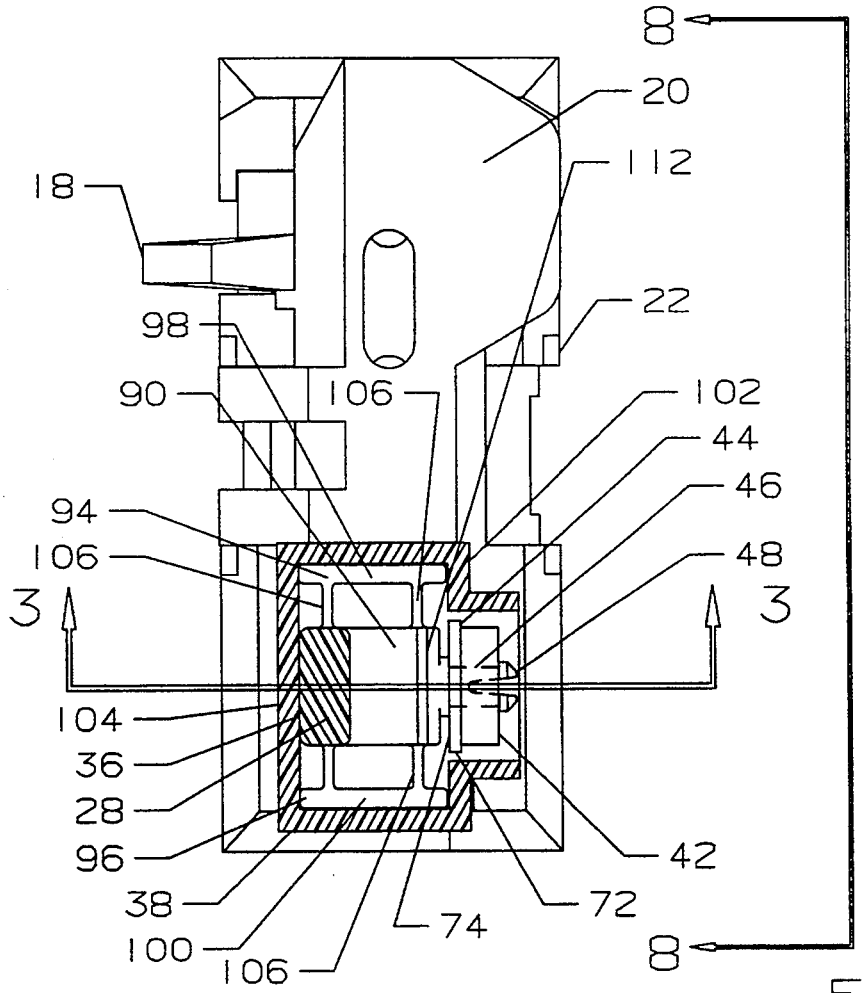
FIG. 2 is a plan view, partially in section, the section being taken along the line 2—2 in FIG. 3, showing a tractor of the type illustrated in FIG. 1 and a mechanism for cutting or trimming the web along a marginal edge which is similar to the cutting or trimming mechanism of the tractor shown in FIG. 1, but in accordance with another embodiment of the invention.
Figure 3:
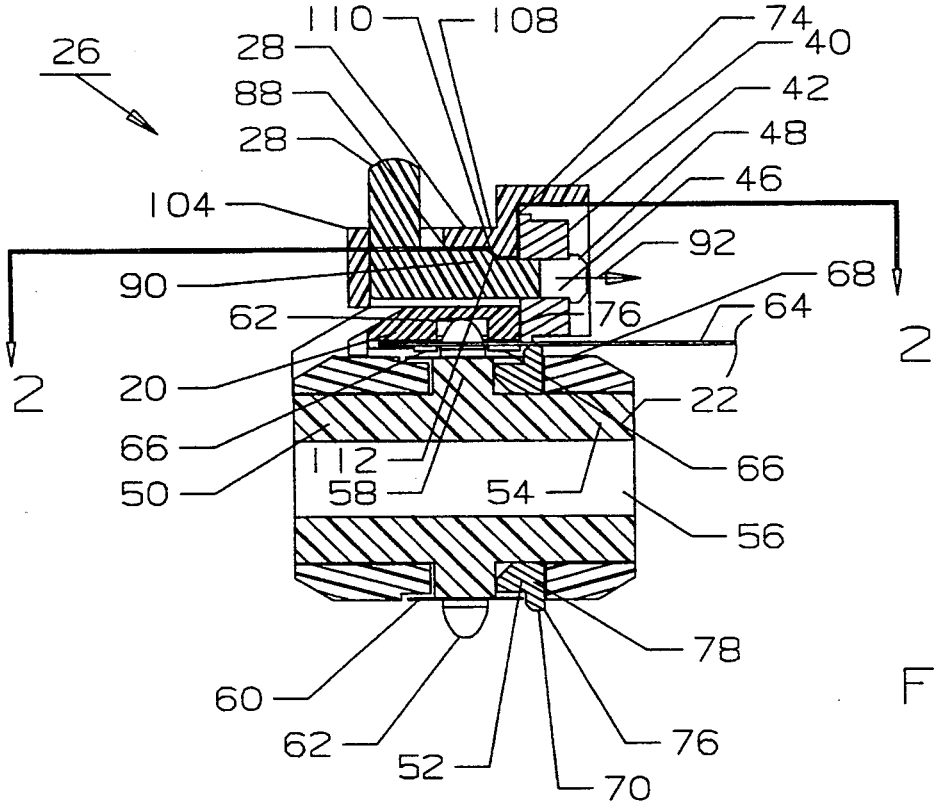
FIG. 3 is a sectional, front, elevational view of the tractor shown in FIG. 2 taken along the line 3—3 in FIG. 2, FIGS. 2 and 3 illustrating the tractor with its lid closed and its cutting mechanism positioned in its non-cutting mode.
Figure 9A:
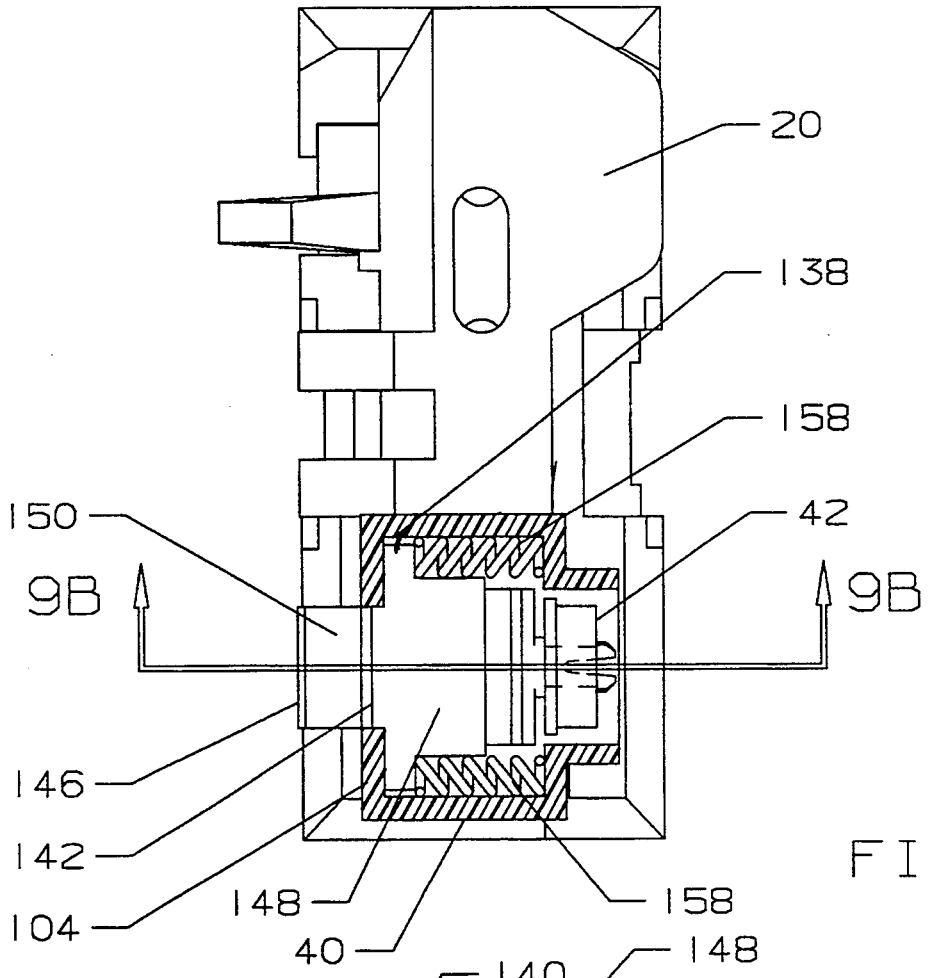
Figure 9B:
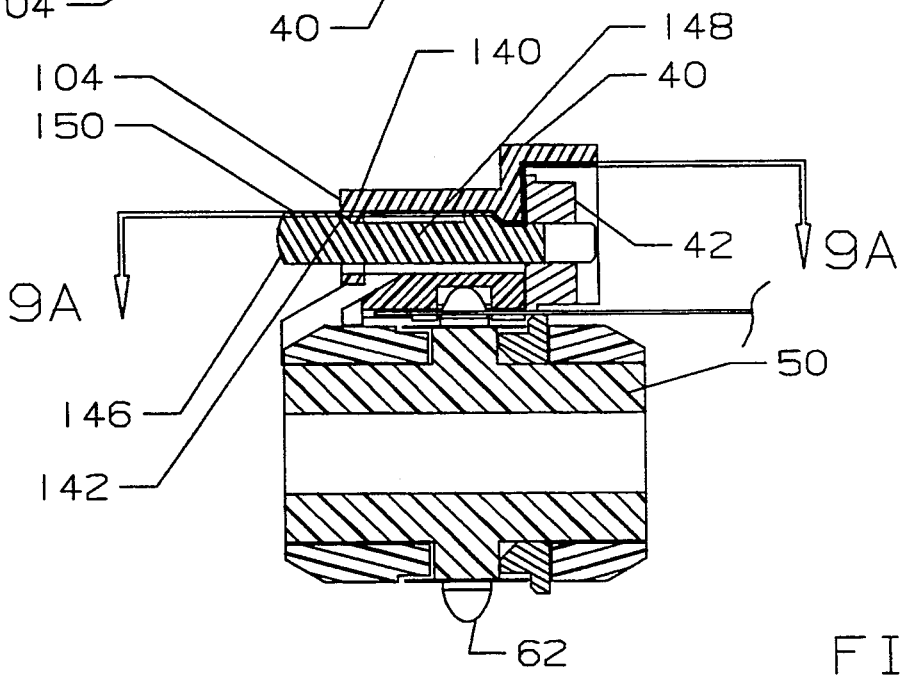

FIG. 9 A and B are views similar to FIGS. 2 and 3 illustrating the cutting mechanism of the tractors illustrated in FIG. 1.

Figure 10A:
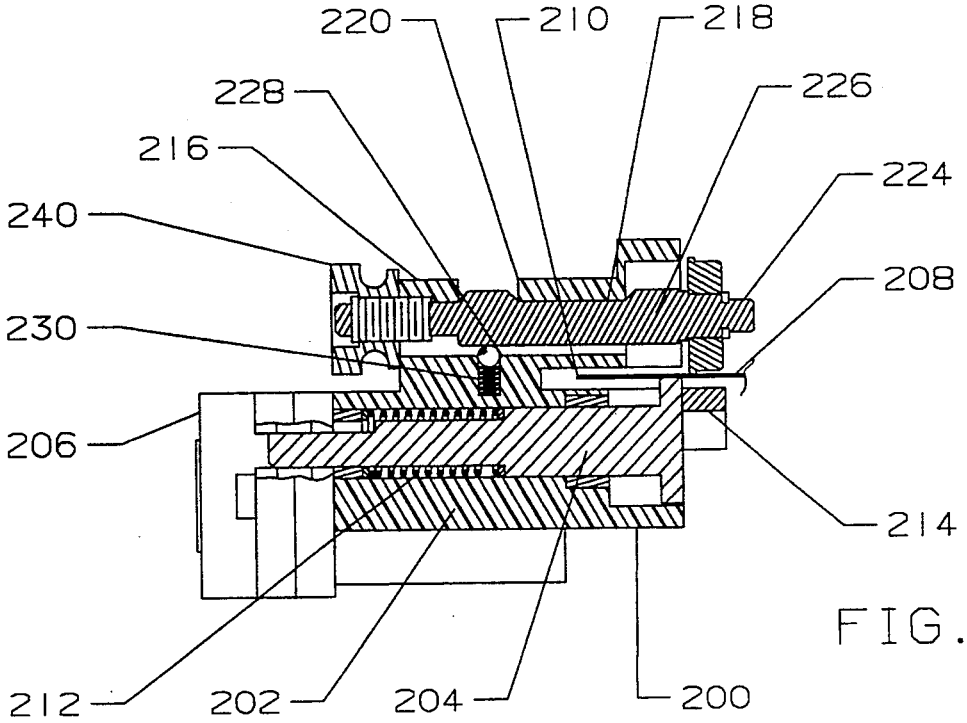

FIGS. 10 A,B, and C are partially sectional plan views of a cutting mechanism in accordance with another embodiment of the invention in a no cut mode position, a cut mode position for a maximum width margin cut, and another cut mode position for minimum width margin cut, respectively.

Referring to FIG. 1, there is shown a pair of tractors 10 and 12 mounted on a support shaft 14 and a fluted drive shaft 16. The tractors have mechanisms operated by arms 18 for clamping them to the support shaft 14 to provide different separations so as to accommodate webs (paper) of different width between the side edges thereof. The clamping mechanisms may be of the type described in U.S. Pat. No. 4,129,239 issued, on Dec. 12, 1978. The tractors have lids 20 which are pivotably mounted on frames 22 and held by flat spring biased journals shown at 24. The journals and flat spring biasing mechanisms may be of the type shown in the above referenced Pat. No. 4,955,520.

Mounted on the lid and movable therewith are the upper parts of paper cutting mechanisms 26 for trimming marginal strips along the side edges of the paper. In order to activate the cutting mode (select a cutting mode) manually, finger actuated handles 28 are movable laterally inward. They are operative to cause the cutting mechanism to latch and be in a position to cut the paper along a cutting line indicated at 30. A line 32 is the center line of the pins which enter the perforations along the marginal edges of the paper and drive the paper longitudinally (in the direction along the side edges). These pins 62 extend from belts 60 which are part of the drive mechanisms located in the frames 22 of the tractors 10 and 12. (See FIGS. 2–9A and B)

Figure 6:
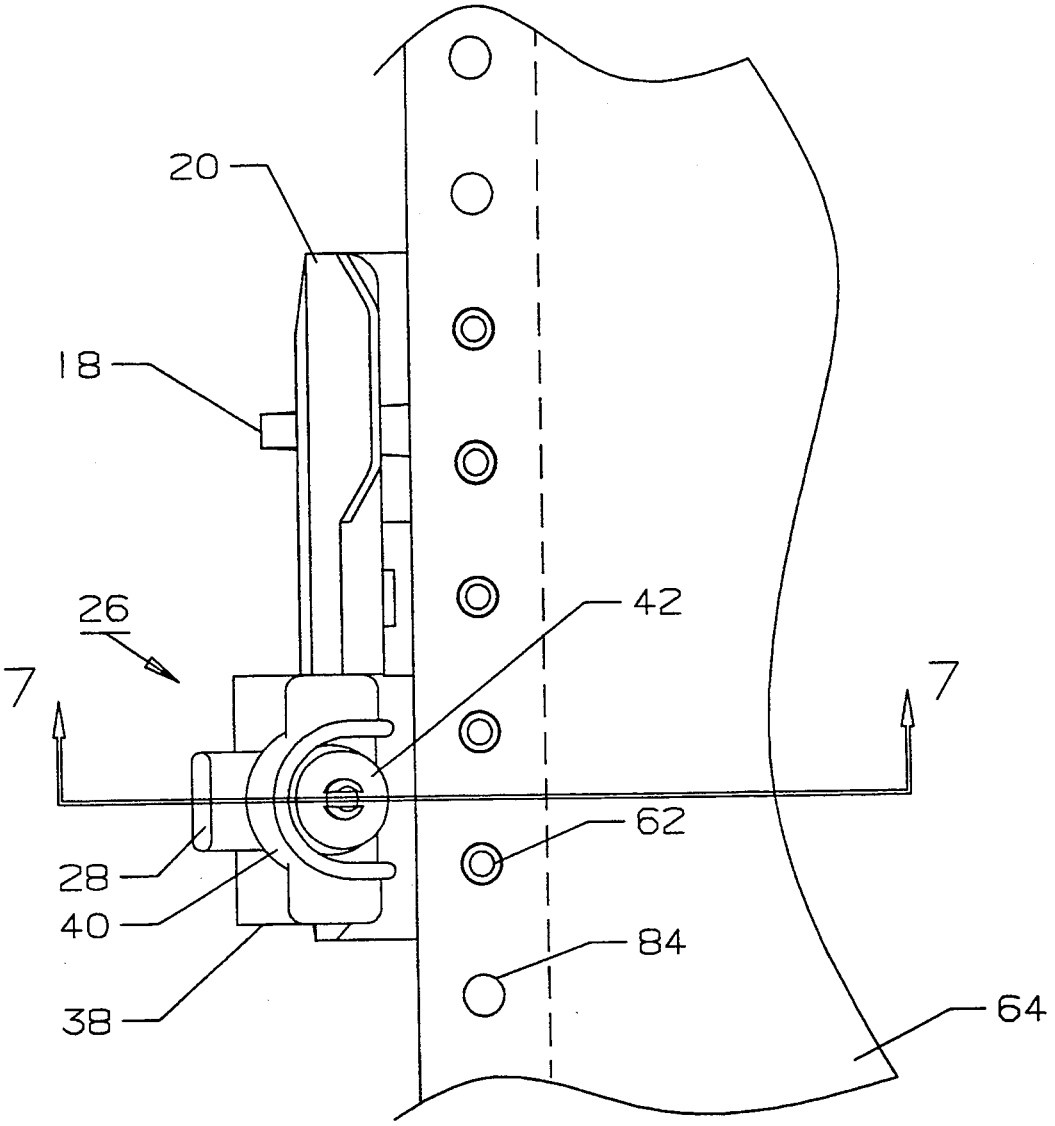
FIG. 6 is a plan view of the tractor shown in FIGS. 2 through 5, but with the lid of the tractor in open position.
Figure 7:
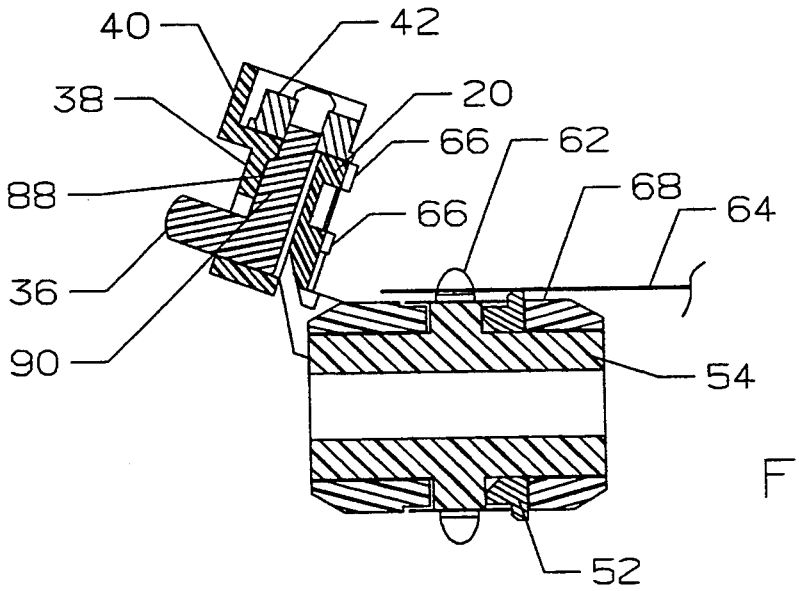
FIG. 7 is a end elevational view taken along the line 7—7 in FIG. 6.
Figure 8:
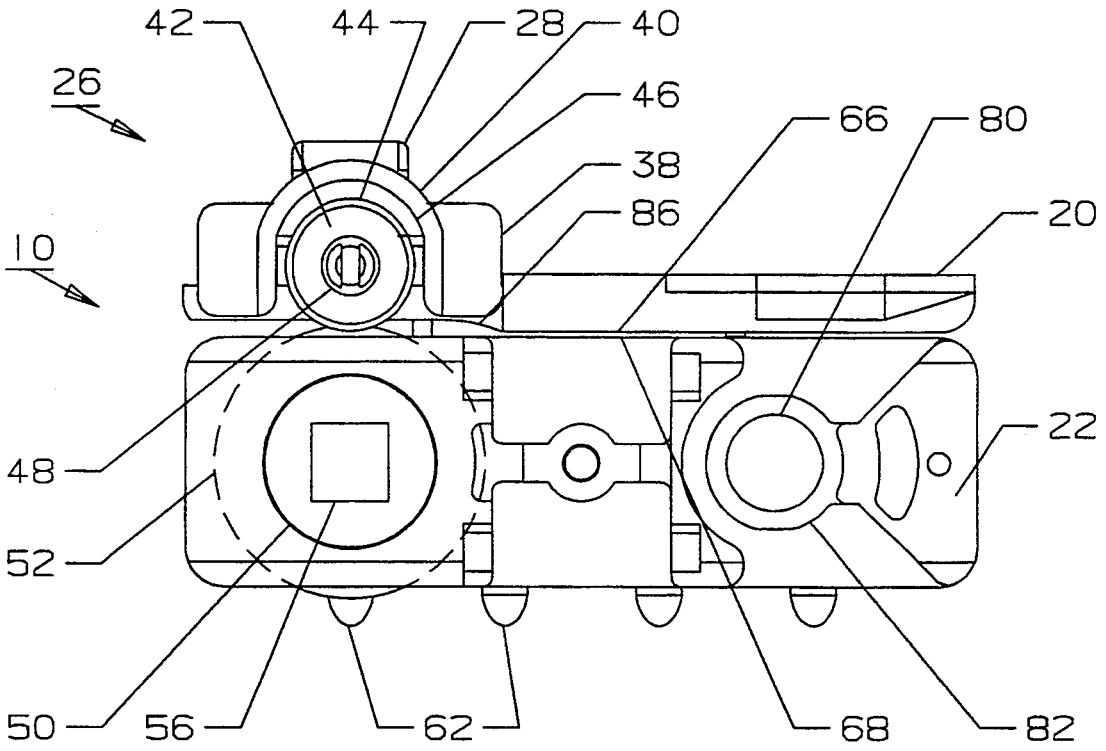
FIG. 8 is an inside elevational view of the tractor shown in closed position, the view being taken along the line 8—8 in FIG. 2 when viewed in the direction of the arrows pointing at the numerals 8—8.

FIG. 8 illustrates one of these tractors 10, but with a cutting mechanism 26 in accordance with another embodiment of the invention which is illustrated in FIGS. 2–7. That mechanism has a handle 28 which projects upwardly and is especially suitable where there is limited room on the outside of the tractors for entry of the operators finger. The mechanism 26 has a housing 38 which is attached, as by cement, to the lid 20. Almost all of the parts of the tractor are of plastic material, such as poly-carbonate, which are readily cemented together by effective plastic cements and glues. The inside end of the housing has an arch shaped extension 40 which encloses a cutting element in the form of a cutting disk 42. This disk may be a sharpened ball bearing having a flange 44 which is mounted on the cylindrical end 46 of an arm or plunger 90 and is held on the end 46 by snapping the disk 42 over a bifurcated, stepped tip 48 (see FIG. 2).

The frame 22 journals a sprocket 50 on which a lower cutting disk 52 (see also FIG. 3) is attached as by being press fit or attached in fashion that couples (connects rotation of) both components together on the outer diameter of the sprocket shaft 54. The sprocket is shown having a square opening 56, which may be fluted when the drive shaft is fluted as shown in FIG. 1. The upper cutting disk 42 and the lower cutting disk 52 may be metal, while the rest of the parts of the tractor are of plastic.

The center section 58 (FIG. 3) of the sprocket has indentations (valleys between teeth) which engage drive lugs or teeth projecting inwardly from a belt 60 from which the pins 62 which extend into perforations or holes (FIG. 6) in the paper 64. The paper is guided by the lower surface 66 of the lid 20 which is adjacent to the upper surface 68 of the frame 22 when the lid 20 is in closed position, as shown in FIGS. 2, 3 and 8. The lower disk 52 is stepped to provide a rim 70 (see FIG. 3) which is opposed to a rim 72 of the upper disk 42. The cutting edge 74 of the upper cutting disk 42 is defined between the rim 72 and the inside surface 76 of the disk 42. A cutting edge 79 of the lower disk 52 is defined by its rim 70 and an outside surface 78 of the disk.

The frame 22 (FIG. 8) has an opening 80 for the support shaft in which a collet 82 of the support shaft clamping mechanism is disposed. This collet is opened and closed by a ring attached to the arm 18 (FIG. 2) for clamping the tractor on the support shaft at the desired lateral position depending upon the lateral width of the paper.

FIGS. 6 and 7 illustrate the paper feed perforations 84 which receive the pins 62. They also show that the lower surface of 66 of the lid 20 is defined by rails or ribs (see e.g. Ferguson U.S. Pat. No. 4,765,523 of Aug. 23, 1988) which are recessed in the area of the upper cutting disk 42, the recess also being illustrated at 86 in FIG. 8. This recess provides additional height in the gap between the surface 66 and the surface 68 through which the paper is guided in the area of the cutting mechanism.

The housing 38 is generally rectangular and has a passage 88 with rectangular walls for the arm or plunger 90. The plunger 90 is generally rectangular and is mounted for reciprocal movement in a direction of the axis of rotation of the upper cutting disk 42 as shown by the arrow 92 in FIG. 3. The arm 90 is mounted for such reciprocal axial movement in parallel beam springs 94 and 96 which have sides 98 and 100 which may be attached in fixed position as by cementing, or in notches (not shown), between inside and outside walls 102 and 104 of the housing 38. The parallel beams 106 of the spring have their ends connected to the sides of the arm 90. Accordingly, the arm 90 is biased toward and indexed against wall 104 of the housing 38. This is the position shown in FIGS. 2 and 3 where the cutting mechanism is in the non cutting mode. In this non cutting mode and retracted position, the rim 72 of the upper disk 42 is displaced from the lower disk 52. Since the disk 42 is free to rotate, even if it contacts the paper 64, it does not interfere with the movement of the paper 64. The rear surface 36 of the handle 28 indexes mechanism 26 in its retracted position in the non-cutting mode.

The inside surface of the upper wall 108 of the housing 38 is formed with a ramp or cam surface 110. A cooperating ramp or cam surface 112 is formed on the upper side of the arm 90.

Figure 4:
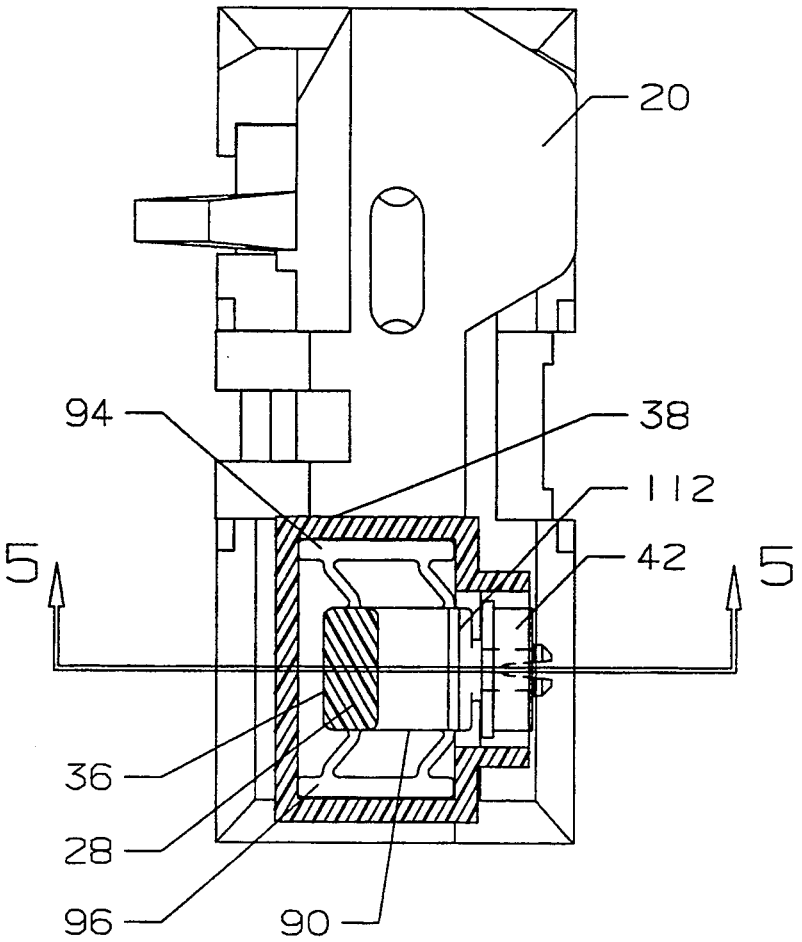
FIGS. 4 and 5 are views similar to FIGS. 2 and 3 of the tractor with its cutting mechanism in the cutting mode.
Figure 5:
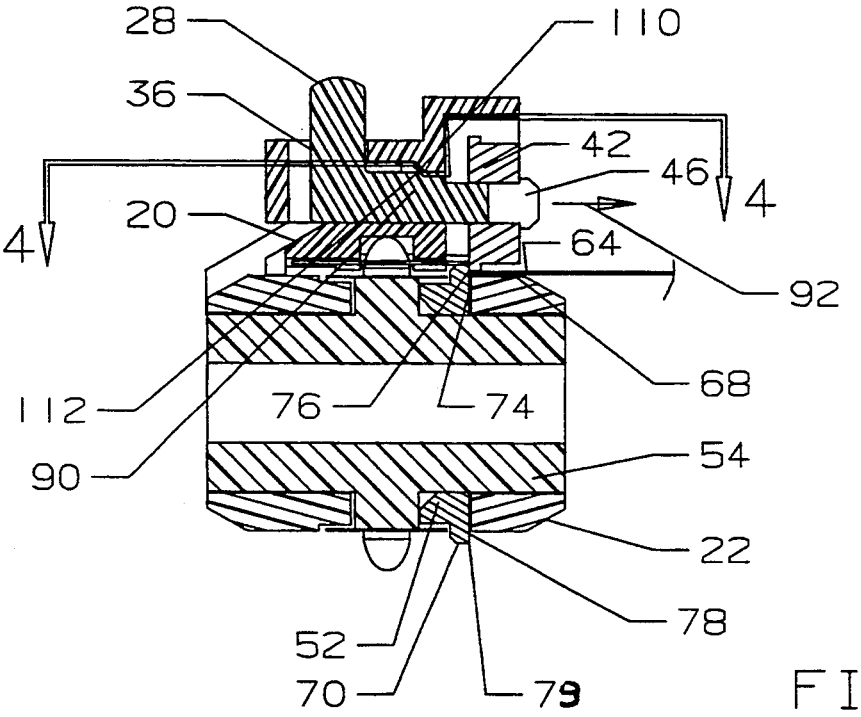

Referring to FIGS. 4 and 5 when the arm 90 is pushed to the right as shown in these figures, the arm 90 ramps downwardly as it moves in the direction of the arrow 92. The lower disk 52 projects above the surface 68 of the frame 22. The inside surface 76 of the upper disk 42 moves over the rim 70 and the inside surface 76 of the upper disk 42 latches on the outside surface 78 of the lower disk 52. The cutting edges 74 of the upper disk and 76 of the lower disk are in overlapping relationship and form a scissors which cuts the paper 64 as the lower disk 52 is driven and the upper disk 42 free wheels on the shaft provided by the end 46 of the plunger 90. In other words, the disks are releasably engaged with each other when in the cutting mode position.

The cutting mechanism 26 provides a mechanical fuse which causes the cutting disks to automatically release and move out of interfering relationship with each other and with the paper 64, if the lid 20 is intentionally opened or the force to cut the paper exceeds the lid's spring tension the lid 20 opens (i.e. the lid may be forced open by uncut paper passing between the rims 72 and 74 of the disks 52 and 42). The inside surface 76 releases from the outside surface 78 of the lower disk 52 and automatically snaps back under the bias of the parallel beam springs 94 and 96. If the scissor action fails to cut the web 64, the force of the paper into the disks forces the lid upwardly against the bias of its spring which holds it in closed position. The upper disk 42 also releases from the lower disk 52 and automatically retracts to the non cutting mode position, where the discs are out of interfering relationship with the paper 64.

FIGS. 9 A and B show an arrangement using a shoulder 138 on the arm 148 which supports the upper disk 42 for reciprocal movement between cutting and non cutting positions. The cam or ramp 140 is provided in the rear wall 104 of the housing and in a step 142 at the rear end 146 of the arm which is located between the handle 150 and the rest of the arm or plunger 148. The plunger 148 is biased outwardly by coil springs 158 which bear against the shoulder 138 and the housing 40. Otherwise the operation of the cutting mechanism is the same as described in connection with FIGS. 2 through 7.

Figure 10B:
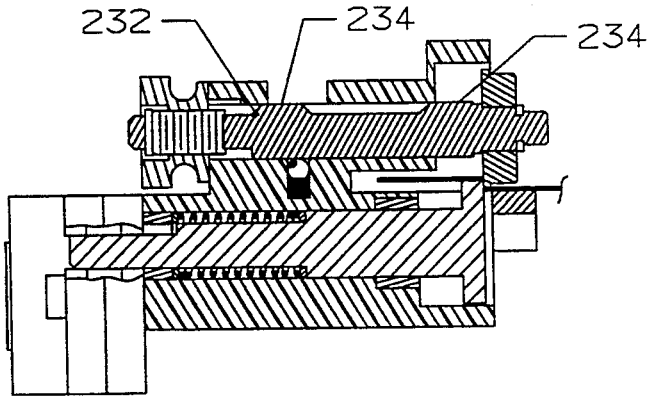
Figure 10C:
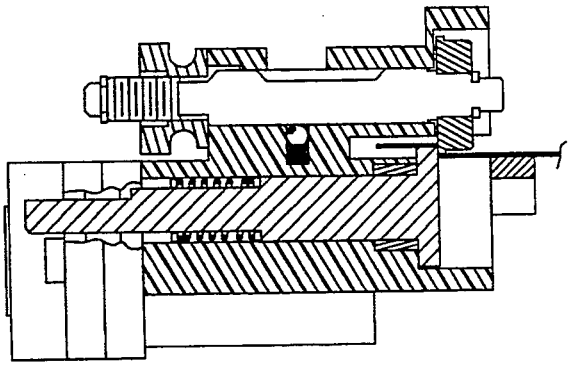

Referring to FIGS. 10 A–C, there is shown a frame 200 having a base 202 in which a cutting element 204, which may be rotated by a drive 206, is movable in a direction laterally of a web 208 to be cut along a marginal edge 210. The cutter biased by a spring 212 toward a stop 214 which may be an extension of the frame 200. A housing 216 has a passage 218 with a hole 220. A cutting element 222 has a sharpened ball bearing cutting disk 224 (like disk 46—FIG. 2) rotatably mounted to a plunger 226 having a rectilinear cross section and which moves laterally in the passage 218 in the housing 216 which also has a rectilinear cross section. The lower surface of the plunger bears against a biasing mechanism including a ball bearing 228 and a spring 230 which are captured in a blind hole in the frame 200. A threaded adjustment knob 240 adjusts the lateral position of the cutter 224. The plunger 226 has ramps 232 to projections 234 from the upper surface of the plunger 226 which control the vertical movement of the plunger and index the cutter in the cut mode positions shown in FIGS. 10B and 10C.

From the foregoing description it will be apparent that there has been provided improved web feeding tractor and to an improved web margin cutter or side perforation burster mechanism. While a belt having pins is described as being the drive mechanism for the web in the foregoing description, it will be appreciated that the drive mechanism may be a pinwheel and the cutting mechanism may be associated with a lid which guides the web over the pinwheel type tractor and the shaft of the pinwheel. Other variations and modifications, within the scope of the invention, will undoubtedly suggest themselves to those skilled in the art. Accordingly the foregoing description should be taken as illustrative and not in a limiting sense.

I claim:

1. In a web feed device having a drive mechanism engageable with the web for driving the web longitudinally in a direction along the side edges thereof, a frame in which said drive mechanism is rotatably supported, said frame having a surface along which said web is driven and a lid moveable with respect to said frame between a position adjacent to said surface of said web where said lid is in guiding relationship with said web and a position away from said frame, a mechanism for cutting a marginal strip along one of the side edges of said web which mechanism comprises a first cutter rotatable with said drive mechanism and having a cutting edge, a second cutter supported on said lid for reciprocal lateral movement with respect to said web and said lid and having a cutting edge, and means for selectively moving said second cutter with respect to said first cutter between laterally spaced positions where said cutting edges are in cutting relationship with each other to cut said marginal strip and are out of cutting relationship with each other.

2. The invention according to claim 1 wherein said cutting edges define a scissor when in said cutting relationship.

3. The invention according to claim 1 further comprising means for biasing said second cutter out of said cutting relationship and said first and second cutters having surfaces which define said edges which are disposed in overlapping relationship when in cutting relationship, the surface of said first cutter releasably retaining said second cutter in cutting relationship with said first cutter.

4. The invention according to claim 3 further comprising a housing attached to said lid in which said second cutter is mounted for said reciprocal lateral movement, and said biasing means is a spring bearing against said housing and against said second cutter.

5. The invention according to claim 4 wherein said second cutter includes an arm and a cutting element, said housing having a lateral passage and said arm being movable in said passage.

6. The invention according to claim 5 wherein said arm and said passage have surfaces defining a ramp for tilting said second cutter towards the first cutter to bring said surfaces of said first and second cutters into said overlapping relationship when said second cutter moves into said cutting relationship.

7. The invention according to claim 5 wherein said first cutter includes a disc which presents said surface having said cutting edge as one side thereof, said cutting element of said second cutter being a disc rotatable on said arm and presenting said surface having said cutting edge thereof as another side surface thereof, said surfaces facing in opposite directions.

8. The invention according to claim 5 wherein said arm has a handle extending therefrom for manual actuation to move said second cutter into said cutting relationship.

9. The invention according to claim 8 wherein said arm has inside and outside ends, said handle being attached to said outside end and said cutting element being attached to said inside end.

10. The invention according to claim 8 wherein said arm defines a plunger inwardly moveable toward said first cutter by said handle.

11. The invention according to claim 4 wherein said second cutter comprises a plunger laterally moveable in said housing, a shoulder extending longitudinally from said plunger, and said spring means being at least one coil spring bearing against said housing and against said shoulder.

12. The invention according to claim 4 wherein said second cutter comprises a plunger having a cutting element connected thereto, a lateral passage in said housing for guiding said plunger, said passage having support surfaces capturing said plunger when said second cutter is moved into said cutting relationship.

13. The invention according to claim 4 wherein said second cutter comprises a plunger having a cutting element at one end thereof, a lateral passage in said housing in which said plunger is moveable, said spring means being parallel beam springs having sides bearing against said housing and extending in said lateral direction and having beams between said sides and said plunger.

14. The invention according to claim 13 wherein said parallel beam springs are formed of elastomeric material.

15. The invention according to claim 3 wherein means are provided for yieldably biasing said lid to said position adjacent said frame, said second cutter being released from cutting relationship with said first cutter to move to a position out of said cutting relationship under the bias of said biasing means when said lid moves away from said position adjacent to said frame.

16. The invention according to claim 1 wherein said web is a paper sheet having side perforations defining said marginal strip between said side perforations and at least one of said side edges, said sheet having feed perforations between said side perforations and said one side edge, said web feed device being a tractor, said drive mechanism including a sprocket, pins moveable by said sprocket and received in said feed perforations, said sprocket having a shaft, said sheet being driven along said surface of said frame, said first cutter comprising a first disc rotatably attached to said shaft and coaxial therewith, said first disc having a diameter greater than the distance between a first axis of rotation of said shaft and said surface so that said first disc has a rim which projects above said surface, said second cutter comprising a second disc rotatable about a second axis in a plane perpendicular to said surface of said frame, said second axis being spaced from said first axis and being disposed generally in said plane, means supporting said second disc for movement in said lateral direction and in a direction transverse to said frame surface between said first and second axes when said first and second discs are moved into said cutting relationship.

17. The invention according to claim 16 wherein said pins project from a belt entrained around said sprocket.

18. The invention according to claim 16 wherein said second disc has a rim defining the cutting edge thereof, said first disc also has a rim which defines the cutting edge thereof, said rims being engageable with each other when said discs are out of said cutting relationship, said discs having surfaces extending radially toward the axis thereof which are engageable with each other when said discs are in cutting relationship.

19. The invention according to claim 1 wherein said web is a paper sheet having side perforations defining said marginal strip between said side perforations and at least one of said side edges, said sheet having feed perforations between said side perforations and said one side edge, and said first and second cutters being operative to burst said side perforations when in said cutting relationship.

20. A mechanism for cutting a marginal strip along one of the side edges of a web, which mechanism comprises:

(a) a first cutter;

(b) a drive mechanism for rotating said first cutter, said first cutter having a cutting edge;

(c) a second cutter having a cutting edge and being reciprocably movable in a lateral direction parallel to the plane of said web and orthogonal to the direction of movement of said web through said mechanism between alternate positions where said cutting edges of said first and second cutters are in cutting relationship with each other and with said web to cut said marginal strip or are out of said cutting relationship, said second cutter remaining in contact with said web at all times; and (d) means for selectively moving said second cutter in said lateral direction between said positions.

21. The mechanism according to claim 20 wherein said cutting edges define a scissor when in said cutting relationship.

22. The mechanism according to claim 20 further comprising means for biasing said at least one of said first and second cutters out of said cutting relationship, and said first and second cutters having surfaces which define said edges which are disposed in overlapping relationship when in cutting relationship, the surface of said first cutter releasably retaining said second cutter in cutting relationship with said first cutter.

23. The mechanism according to claim 22 further comprising a housing in which said second cutter is mounted for said reciprocal lateral movement, and said biasing means is a spring bearing against said housing and against said second cutter.

24. The mechanism according to claim 23 wherein said second cutter includes an arm and a cutting element, said housing having a lateral passage and said arm being movable in said passage.

25. The mechanism according to claim 24 wherein at least one of said arm and said passage have surfaces defining a ramp for enabling said second cutter to move in a direction transverse to bring said surfaces of said cutters into said overlapping relationship when said second cutter moves into said cutting relationship.

26. The mechanism according to claim 24 wherein said second cutter comprises a plunger having a cutting element connected thereto, a lateral passage in said housing for guiding said plunger, said passage having support surfaces capturing said plunger when said second cutter is moved into said cutting relationship.

27. The mechanism according to claim 23 wherein said first cutter includes a disc which presents said surface having said cutting edge as one side thereof, said cutting element of said second cutter being a disc rotatable on said arm and presenting said surface having said cutting edge thereof as another side surface thereof, said side surfaces facing in opposite directions.

28. The mechanism according to claim 23 wherein said second cutter comprises a plunger laterally moveable in said housing, said plunger housing and surface extending in a direction along which said plunger is laterally moveable, and said spring means being at least one coil spring bearing against said housing and against said surface of said plunger.

29. The mechanism according to claim 20 wherein said web is a paper sheet having side perforations defining said marginal strip between said side perforations and at least one of said side edges, said sheet having feed perforations between said side perforations and said one side edge, and said first and second cutters being operative to burst said side perforations when in said cutting relationship.

* * * * *